US005295743A

United States Patent [19]

Moulton et al.

[11] Patent Number: 5,295,743

[45] Date of Patent: Mar. 22, 1994

[54] SECURE CABINETS

[75] Inventors: John L. Moulton; Frank G. Camilleri, both of Brampton; Gordon F. Pranschke, Ottawa, all of Canada

[73] Assignee: Dasco Data Products Limited, Brampton, Canada

[21] Appl. No.: 755,645

[22] Filed: Sep. 6, 1991

[51] Int. Cl.[5] ..... E06B 9/15

[52] U.S. Cl. ..... 312/297; 312/223.6; 160/236; 70/97

[58] Field of Search ..... 312/215, 223.6, 297; 160/37, 118, 235, 236; 108/150; 109/51, 59, 73; 70/95, 97; 292/302

[56] References Cited

U.S. PATENT DOCUMENTS

| | | | |
|---|---|---|---|
| 2,827,118 | 3/1958 | Wendt | 312/297 X |
| 3,213,652 | 10/1965 | Tucker | 70/97 |
| 3,437,126 | 4/1969 | Schroeder | 160/235 |
| 4,441,768 | 4/1984 | Clarkson | 312/297 X |
| 4,549,777 | 10/1985 | Schindler | 312/223.6 X |
| 4,948,205 | 8/1990 | Kelley | 312/223.6 X |

FOREIGN PATENT DOCUMENTS

| | | | |
|---|---|---|---|
| 42809 | 12/1981 | European Pat. Off. | 312/297 |

OTHER PUBLICATIONS

Brochure distributed by Dasco Data Products Ltd. Jan., 1991.

*Primary Examiner*—Brian K. Green

[57] ABSTRACT

There is described a rectangular shaped security cabinet having a door opening which is closed by a tambour door. The door is made from a plurality of interlocking slats capable of limited flexure relative to one another, the slats having interlocking hooked tongues on the upper faces which lockingly engage with slots on the lower faces. A protection barrier extends from the top face behind the hooked tongue and inhibits access to the joint formed by the hooked tongue and the receiving slots. Additionally the door is provided with a lock operated by a combination lock which lock includes a sliding bar at the back of the door which engages with upstanding projections on the door bottom sill. A cam like latch, biased to the open position is operable by the combination lock to engage in a catch on the sliding bar to lock the bar and thus the door, in the locked position. Further, there is described a secure rear panel in which the rivets which lock the panel to the back of the cabinet housing are not accessible from the outside. Finally, there are described various elements for providing a tortuous path for electrical wiring entering into the cabinet to inhibit access to the cabinet along the wiring paths.

18 Claims, 8 Drawing Sheets

SECURE CABINETS present invention relates to secure cabinets and particularly to cabinets for office and similar use, for storing sensitive documents and equipment.

BACKGROUND OF THE INVENTION

In institutions handling sensitive military or commercial documents or equipment and appliances, such as telex and telephone links, it is necessary to provide secure storage for the sensitive materials when the offices are not operational, such as at night, on weekends, or on statutory holidays.

Cabinets which have been provided in the past have been prone to tampering by, for example, inserting a hacksaw blade between the slats of a tambour door, by undoing external fastenings to remove a panel from the cabinet, and the like.

STATEMENT OF THE INVENTION

The present inventions seeks to provide a cabinet with which it is difficult to tamper, which will provide evidence of tampering attempts and which provides a high degree of security.

According to one aspect of the present invention there is provided a security cabinet comprising a housing having a front with a door opening, a tambour door mounted on said housing movable between a first position wherein said door opening is uncovered and a second position wherein said door opening is covered, said door comprising a plurality of interlocked slats capable of limited flexure relative to one another, each slat having a frontal wall with an outwardly directed front face and an upper side wall and a lower side wall, one of said upper and lower side walls having a hooked tongue means extending therefrom, the other of said upper or lower side walls having a tongue receiving and retaining slot means, and each slat having a protection barrier extending from the same side wall as the hooked tongue means and positioned on said same side wall inwardly from said outwardly directed front face and inwardly from, and behind said hooked tongue means, said protection barrier member of any one slat to inhibit access to a joint formed by the hooked tongue means on said one slat with the receiving and retaining slot means of an adjacent slat when the hooked tongue means of said one slat is received and retained in the receiving and retaining slot means of said adjacent slat.

According to another aspect of the present invention there is provided a security cabinet comprising a housing having a door opening, a tambour door mounted on said housing movable between a first position wherein said door opening is uncovered and a second position wherein said opening is covered said door comprising a plurality of interlocked slats capable of limited flexure relative to one another, each slat having a frontal wall with an outwardly directed front face and an upper side wall and a lower side wall, one of said upper or lower side walls having a hooked tongue means extending therefrom, the other of said upper or lower side walls having a tongue receiving and retaining slot means, and each slat having a protection barrier member extending from the same side wall as the hooked tongue means and positioned on said same side wall inwardly from, said outwardly directed front face and inwardly from and behind said hooked tongue means, said protection barrier member of any one slat to inhibit access to a joint formed by the hooked tongue means of said one slat with the receiving and retaining slot means of an adjacent slat, when the hooked tongue means of said one slat is received and retained in said receiving and retaining slot means of said adjacent slat; a leading edge on said door; locking means adjacent said leading edge to lock with a cooperating locking surface; said locking means comprising a bar means mounted for locking and unlocking movement transversely of said door opening at a rear face of one of said leading edge and said cooperating locking surface and carrying engagement means adapted to releasably engage with at least one locking projection on the other of said leading edge and cooperating locking surface; latch means mounted adjacent said bar means, catch means on said bar means to lockingly receive said latch means, biasing means to bias said latch means in a direction away from said catch means; and securing means operable from outside said cabinet to, on the one hand overcome said biasing means and force said latch means into said catch means to prohibit transverse movement of the bar and, on the other hand, to release said latch means to permit the biasing means to withdraw said latch means from said catch means.

According to another aspect of the invention there is provided a security cabinet comprising a housing having a door opening: a tambour door mounted on said housing movable between a first position wherein said door opening is uncovered and a second position wherein said opening is covered; said door comprising a plurality of interlocked slats capable of limited flexure relative to one another; a leading edge on said door,a cooperating locking surface; locking means adjacent one of said leading edge and said cooperating locking surface said locking means comprising a bar means mounted for locking and unlocking movement transversely of said door opening at a rear face of one of said leading edge and said cooperating locking surface and carrying engagement means adapted to releasably engage with at least one locking projection of the other of said leading edge and cooperating locking surface; latch means mounted adjacent said bar; catch means on said bar to lockingly receive said latch mans; biasing means to bias said latch means in a direction away from said catch means; and securing means operable from outside said cabinet to, on the one hand, overcome said biasing means and force said latch means into said catch means to prohibit transverse movement of the bar means and, on the other hand, to release said latch means to permit its biasing means to withdraw said latch means from said catch means.

According to another aspect of the present invention there is provided a security cabinet comprising a housing having a door opening; a tambour door having an outwardly directed front face and an inwardly directed rear face, said door being mounted on said housing movable between a first position wherein said door opening is uncovered and a second position wherein said opening is covered; said door comprising a plurality of interlocked slats capable of limited flexure relative to one another; a leading edge on said door, locking means adjacent said leading edge to lock said leading edge with a cooperating locking surface, said locking means comprising a bar means mounted at a rear face of said leading edge for locking and unlocking movement transversely of said door opening, engagement means on said bar adapted to releasably engage with at least one locking projection on said cooperating locking surface; latch means on the rear face of said door adjacent said bar, catch means on said bar to lockingly receive said latch means; biasing means to bias said latch means in a direction away from said catch means; and securing means operable from said outwardly directed front face of said door to, on the one hand overcome said biasing means and force said latch means into said catch means to prohibit transverse movement of the bar, and, on the other hand, to release said latch means to permit the biasing means to withdraw said latch means from said catch means.

According to another aspect of the present invention there is provided a security cabinet comprising a housing having a door opening, a tambour door mounted on said housing movable between a first position wherein said door opening is uncovered and a second position wherein said opening is covered said door comprising a plurality of interlocked slats capable of limited flexure relative to one another, each slat having a frontal wall with an outwardly directed front face and an upper side wall and a lower side wall, one of said upper or lower side walls having a hooked tongue means extending therefrom, the other of said upper or lower side walls having a tongue receiving and retaining slot means, and each slat having a protection barrier member extending from the same side wall as the hooked tongue means and positioned on said same side wall inwardly from said outwardly directed front face and inwardly from, and behind said hooked tongue means, said protection barrier member of any one slat to inhibit access to a joint formed by the hooked tongue means of said one slat with the receiving and retaining slot means of an adjacent slat, when the hooked tongue means of said one slat is received and retained in said receiving and retaining slot means of said adjacent slat; left and right side members of said housing each having a rear edge, said left and right members mounting vertically extending channel guideways proximate said rear edges thereof, said guideways being inwardly directed to face each other; a cabinet roof having a substantially U-shaped upper structural member formed integrally with the cabinet roof and extending transversely and inwardly thereof; a lower structural member formed integrally with a floor of the cabinet and extending transversely thereof inwardly of said guideways; a back side panel extending vertically within the guideways and terminating at its upper end in an L-section cross member engaging the inside of an inner upstanding web of said U-shaped upper structural member and riveted thereto from the inside of said cabinet; and an inwardly directed bottom edge on said back side panel engaging said lower structural member and riveted thereto from the underside of said cabinet.

According to a further feature of the invention there is provided a security cabinet comprising a four sided housing including a front side, a door opening in the front side of said housing, a door mounted on said housing movable between a first position wherein said door opening is uncovered and a second position wherein said opening is covered; left and right side members of said housing each having a rear edge, the left and right side members mounting vertically extending channel guideways proximate the rear edges thereof, said guideways being inwardly directed to face each other; a cabinet roof having a substantially U-shaped upper structural member formed integrally with the cabinet roof and extending transversely and inwardly thereof; a lower structural member formed integrally with a floor of the cabinet and extending transversely thereof inwardly of said guideways; a back side panel extending vertically within the guideways and terminating at its upper end in an L-section cross member engaging the inside of an inner upstanding web of said U-shaped upper structural member and riveted thereto from the inside of said cabinet; and an inwardly directed bottom edge on said back side panel engaging said lower structural member and riveted thereto from the inside of said cabinet.

According to another aspect of the present invention there is provided a security cabinet comprising a housing having a door opening, a tambour door mounted on said housing movable between a first position wherein said door opening is uncovered and a second position wherein said opening is covered, said door comprising a plurality of interlocked slats capable of limited flexure relative to one another, each slat having a frontal wall with an outwardly directed front face and an upper side wall and a lower side wall, one of said upper or lower side walls having a hooked tongue means extending therefrom, the other of said upper or lower side walls having a tongue receiving and retaining slot means, and each slat having a protection barrier member extending from the same side wall as the hooked tongue means and positioned on said same side wall inwardly from said outwardly directed front face and inwardly from and behind said hooked tongue means, said protection barrier member of any one slat to inhibit access to a joint formed by the hooked tongue means of said one slat with one receiving and retaining slot means of an adjacent slat, when the hooked tongue means of said one slat is received and retained in said receiving and retaining slot means of said adjacent slat; a first outer panel having an inwardly directed face, said outer panel forming one side of said cabinet; an inner panel structurally secured to the inside of said cabinet and spaced inwardly from, and parallel to, said outer panel to form a wiring space between the panels, said inner panel having an outwardly directed rear face facing said inwardly directed face of said outer panel; a substantially U-shaped member attached to said outwardly directed rear face of said inner panel and forming therewith an open topped and bottomed box member having a first side and an opposite side; an electrical wiring entrance aperture in said outer panel vertically displaced thereon from said box member; a wiring inlet aperture on the first side of the box member; a wiring outlet aperture on the opposite side of the box and vertically spaced thereon from said inlet aperture; and a wiring exit aperture in said inner panel and vertically displaced thereon from said box and said entrance aperture, whereby wiring entering said entrance aperture, passing through said box and through said exit aperture is forced to follow a tortuous path.

According to still a further feature of the invention there is provided a security cabinet comprising a rectangular housing, a door opening in the front of said housing, a door mounted on said housing movable between a first position wherein said door opening is uncovered and a second position wherein said opening is covered; a first outer panel forming one side of said cabinet; an inner panel structurally secured to the inside of said cabinet and spaced inwardly from, and parallel to, said outer panel to form a wiring space between the panels; a substantially U-shaped member attached to the back of said inner panel and forming therewith an open topped and bottomed box member; an electrical wiring entrance aperture in said outer panel vertically displaced thereon from said box member; a wiring inlet aperture in one of the sides of the box member; a wiring outlet aperture on the opposite side of the box and vertically spaced thereon from said inlet aperture; and a wiring exit aperture in said inner panel vertically displaced thereon from said box and said entrance aperture, whereby wiring entering said entrance aperture, passing through said box and through said exit aperture is forced to follow a tortuous path.

BRIEF DESCRIPTION OF THE DRAWINGS

The following is a description by way of example of certain embodiments of the present invention reference being had to the accompanying drawings in which.

DESCRIPTION OF PREFERRED EMBODIMENTS

Figure 2:
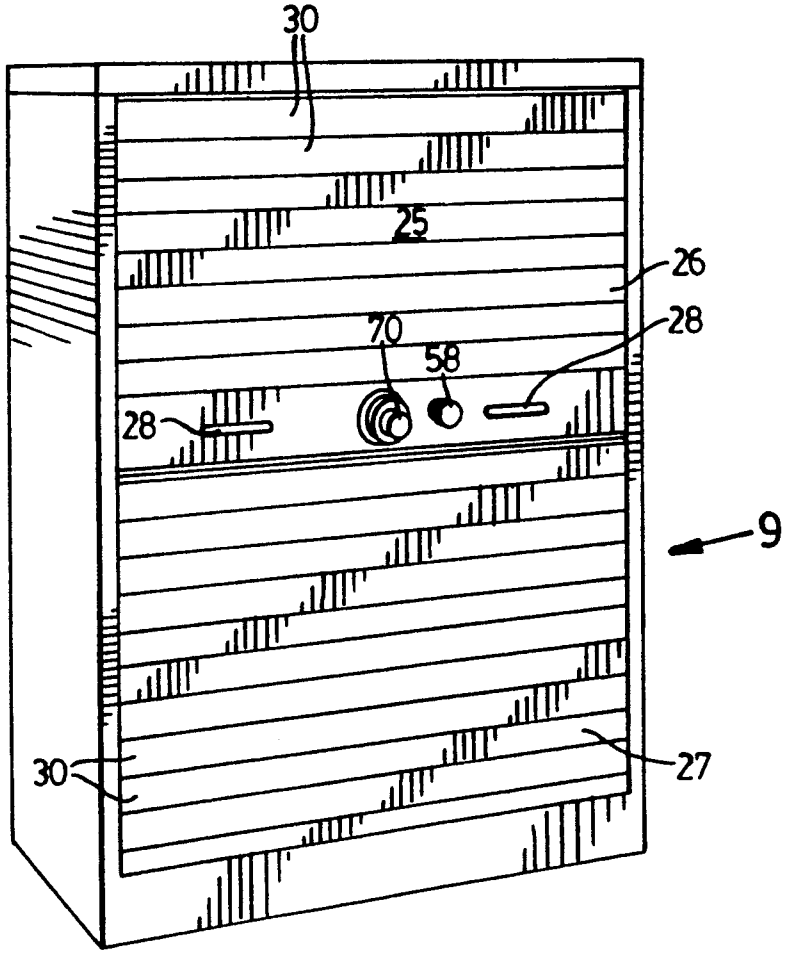
FIG. 2 is a view similar to FIG. 1 but with the door closed.

Turning now to the drawings and particularly to FIGS. 1 through 4. A metal security cabinet 20 is of rectangular configuration having a front door opening 21, side panels 22, 23 and a roof 24. The door opening 21 is closed by a tambour door 25.

In FIG. 2 the tambour door 25 is shown comprising top and bottom half sections, 26, 27 meeting in the middle of the door opening for locking purposes.

Figure 4:
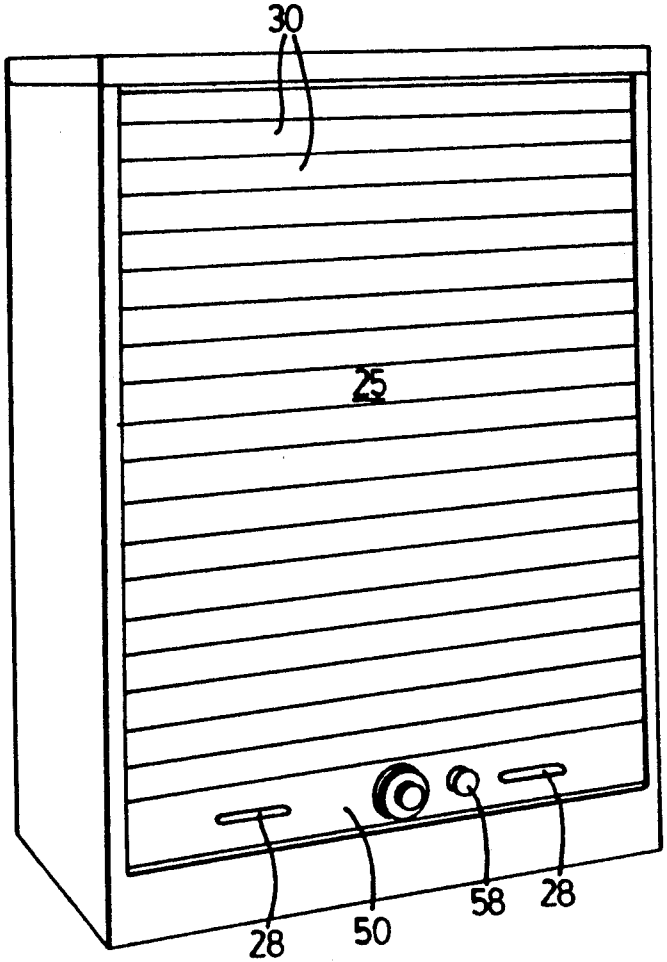
FIG. 4 is a view similar to FIG. 3 but with yet a further different form of door construction.
Figure 3:
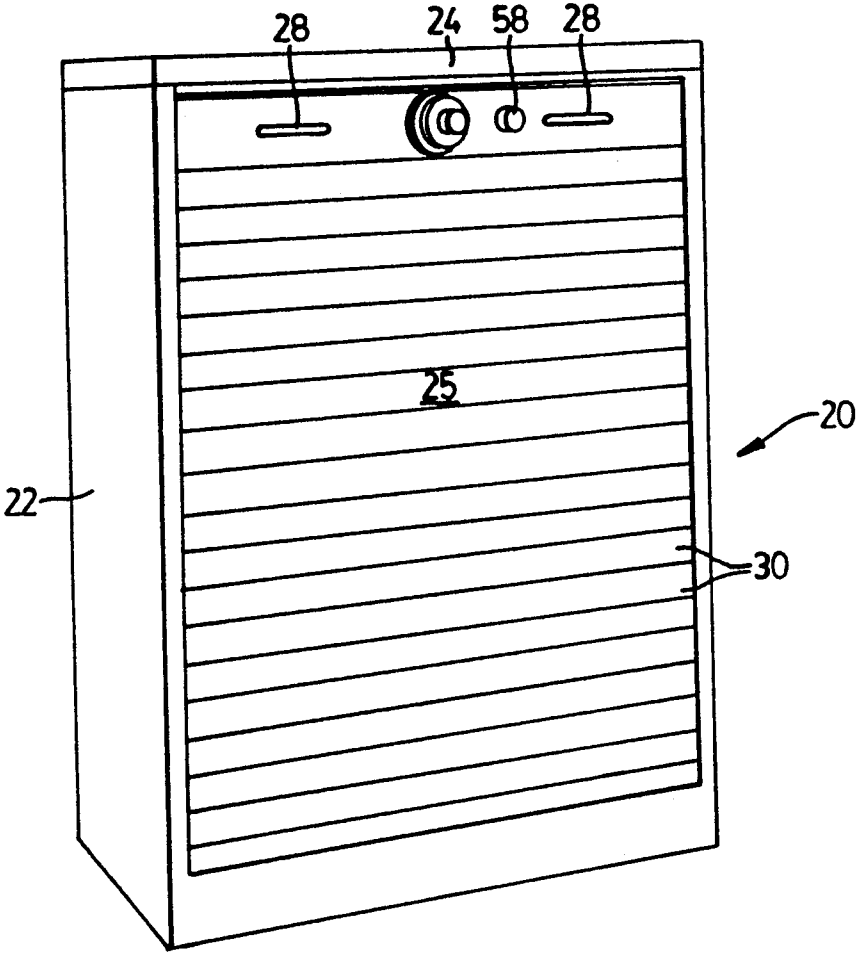
FIG. 3 is a view similar to FIG. 2 but with a different form of door construction.

In FIG. 3, the tambour door 25 is shown as a single section door, and locking at the upper part of the door opening, adjacent the roof 24, whilst in FIG. 4 the single section tambour door 25 is shown locking to the cabinet structure at the bottom of the door opening. The doors are raised and lowered by means of handles 28.

Turning now to FIGS. 9, 10A through 10D, 11 and 12. The tambour doors are made from a plurality of interlocking adjacent metal slats 30. Each slat 30 has a frontal wall 31 with an outwardly directed front face 37, an upper wall 32 and a lower side wall 33. In the configuration shown a hooked tongue 35 is pressed out of the upper side wall 32 and has a longitudinally extending hook finger 36.

Figure 11:
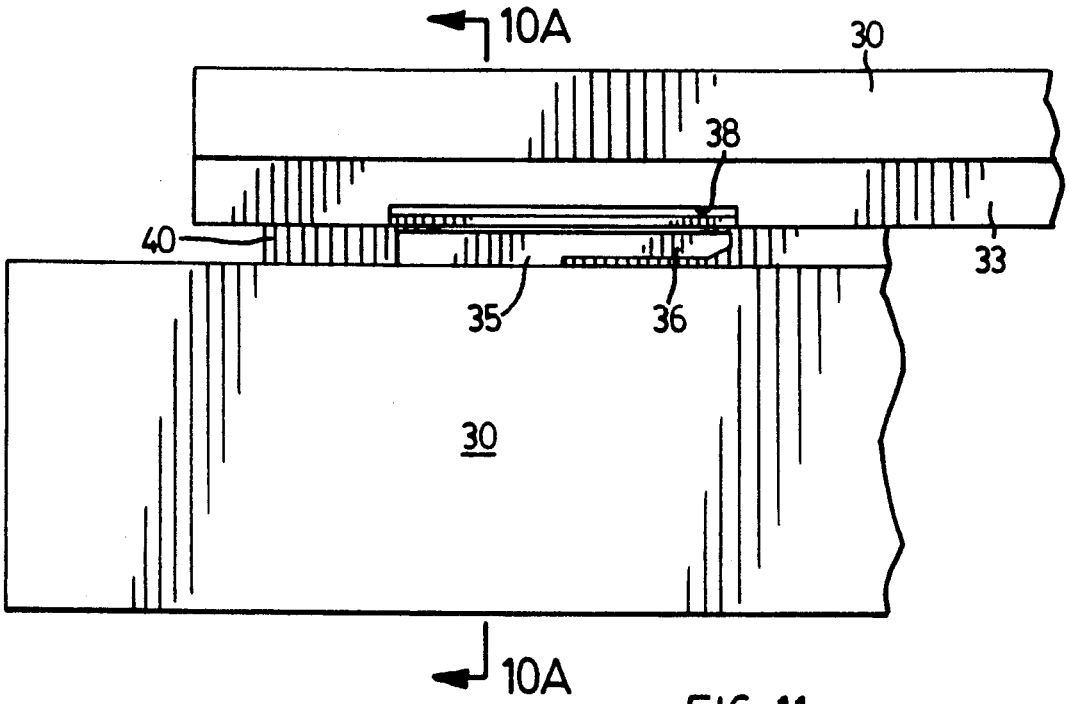
FIG. 11 is a part front elevation depicting the assembling situation similar to FIG. 9.
Figure 12:
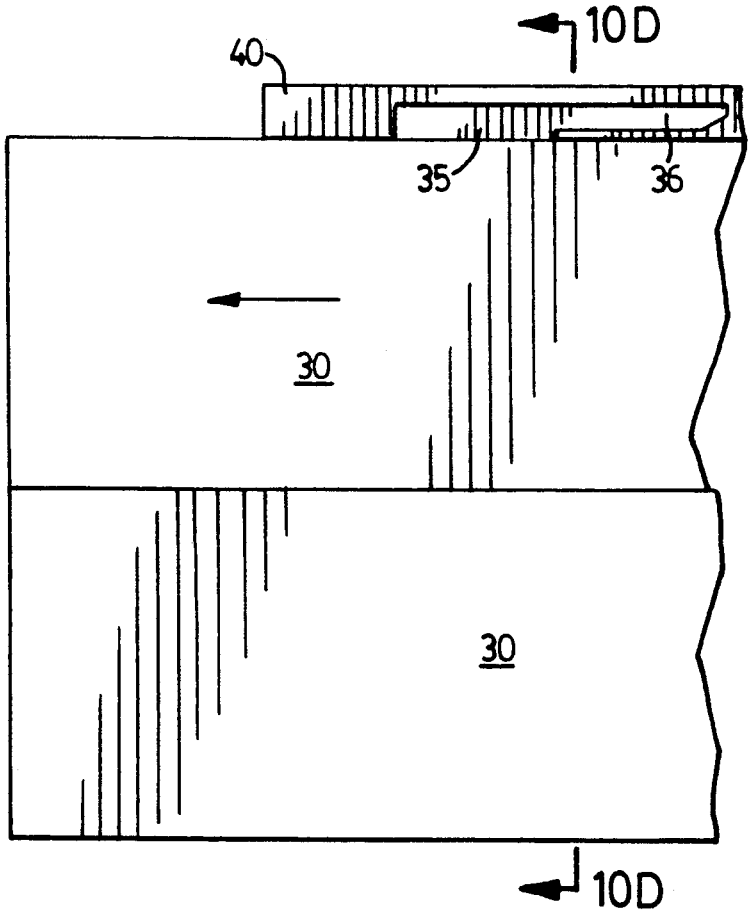
FIG. 12 is a view similar to FIG. 11 but with the slats moved horizontally into place with each other.

At the corner of the lower side wall 33 of each slat 30 there is provided a hook receiving slot 38 and in order to assemble the slats in a fashion to provide limited flexure between them, the hooked tongue member 35 with its finger 36 is inserted into the slot 38, as seen in FIG. 11 and the upper slat 30 is then rotated and moved, as seen in FIG. 12 from right to left so that the hook finger 36 firmly contacts with the inside surface of the lower face 33 of the next adjacent slat.

Figures 10A, 10B, 10C, 10D:
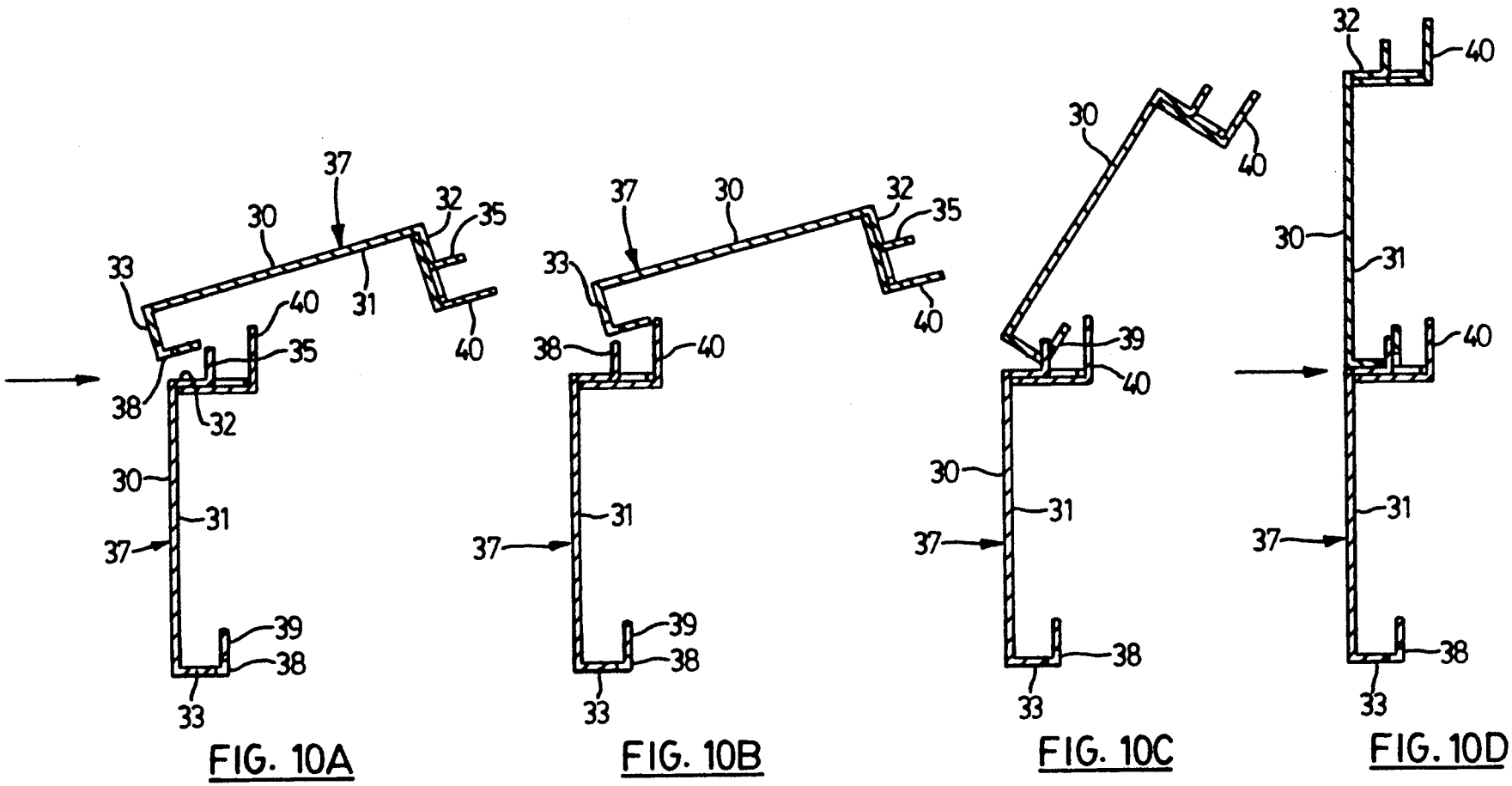
FIGS. 10A through 10D are sectional representations of the form of assembly of adjacent slats as indicated in FIG. 9 FIG. 10A being a section along the line 10A–10A in FIG. 11 and FIG. 10D being a section along the line 10D–10D in FIG. 12.

The steps of assembly are set out in more detail in FIGS. 10A through 10D. In FIG. 10A the upper slat 30 is brought into proximity with the lower slat 30, in FIG. 10B the upper and lower slats 30 are brought into close relation, in FIG. 10C the hooked tongue 35 on the lower slat is inserted into the receiving and retaining slot 38 in the upper slat and in FIG. 10D the upper slat is moved into the plane of the paper relative to the lower slat so that the hook finger 36 firmly engages with the inner side of the lower side wall 33. The lower side wall 33 is provided with an upstanding wall portion 39 which, when the slats are assembled enables the lower side wall 33 to embrace the hooked tongue 35.

In order to inhibit tampering with the slats, say, by inserting a hacksaw blade between adjacent slats, a protection barrier 40 is provided on the face carrying the tongue 35, in the embodiment shown, the upper side wall 32, and extends, along the side wall 32 behind the hooked tongue 35. Protection barrier 40 may span the entire length of the slat 30.

Turning now to FIGS. 7 and 8 and again to FIG. 4. In this embodiment, the tambour door 25 is provided with a leading edge 50 member(hereinafter referred to as leading edge 50). A locking means generally indicated at 51 (see FIGS. 7 and 8) comprises a bar 52 having an upper portion 60 slidably mounted transversely of the door opening 21 on the rear of the leading edge 51. The bar portion 60 is moved from left to right by means of a handle 5 outside of the cabinet (see FIGS. 1 and 4). The handle 58 has a bolt which passes through and slides in a slot 57 in the leading edge 50 and connects with an inside plate 55. The plate 55 is fixed to the moving bar portion 60. The bar 52 also has a fixed portion or section 61 which forms the actual door edge. Both sections of the bar 61 and 60 are provided with aligned slots 62, 63 which receive upstanding hardened steel locking projections 64 (see also FIG. 1) upstanding from a cooperating locking surface, in the configuration shown in FIGS. 1 and 4, the bottom sill 66 of the door opening. The projections 64 are cylindrical in shape, terminating in enlarged conical heads 67. When the leading edge of the door contacts the sill the projections 64 pass through the aligned holes 62, 63 in the bar and when the bar section 60 is moved by means of the handle 58 transversely of the door opening, the sliding section or portion 60 of the bar engages, at the edge of its slots 63 beneath the conical heads 67, as best seen in FIG. 7.

Mounted to the leading edge 50 is a Sargent and Green combination lock 70. The combination lock has a retractable bolt 71.

Figure 8:
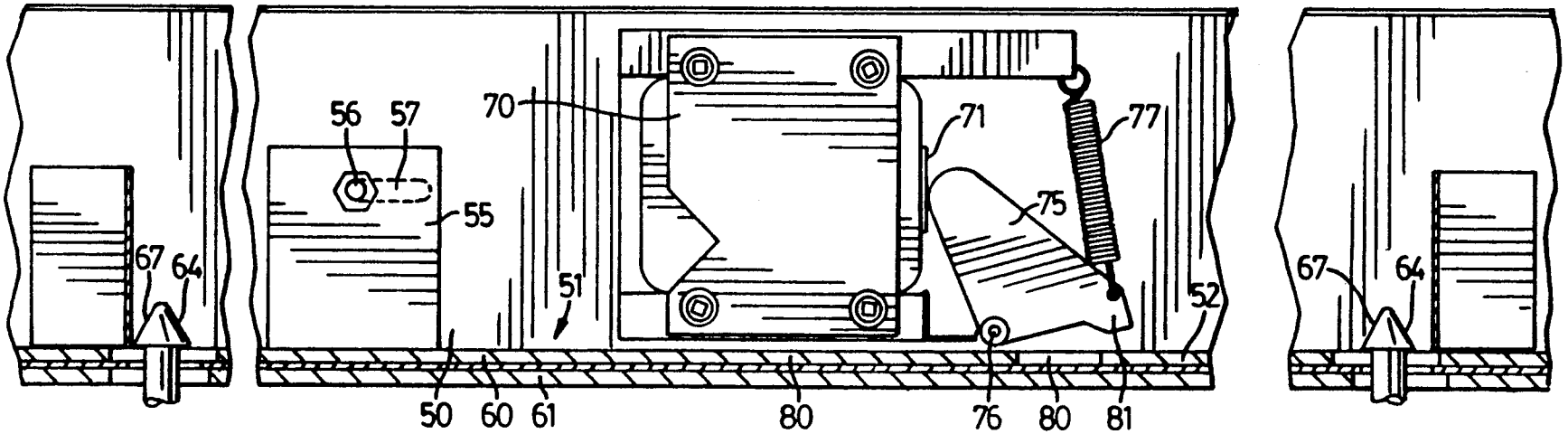
FIG. 8 is a view similar to FIG. 7 but with the lock in the unlocked position.
Figure 9:
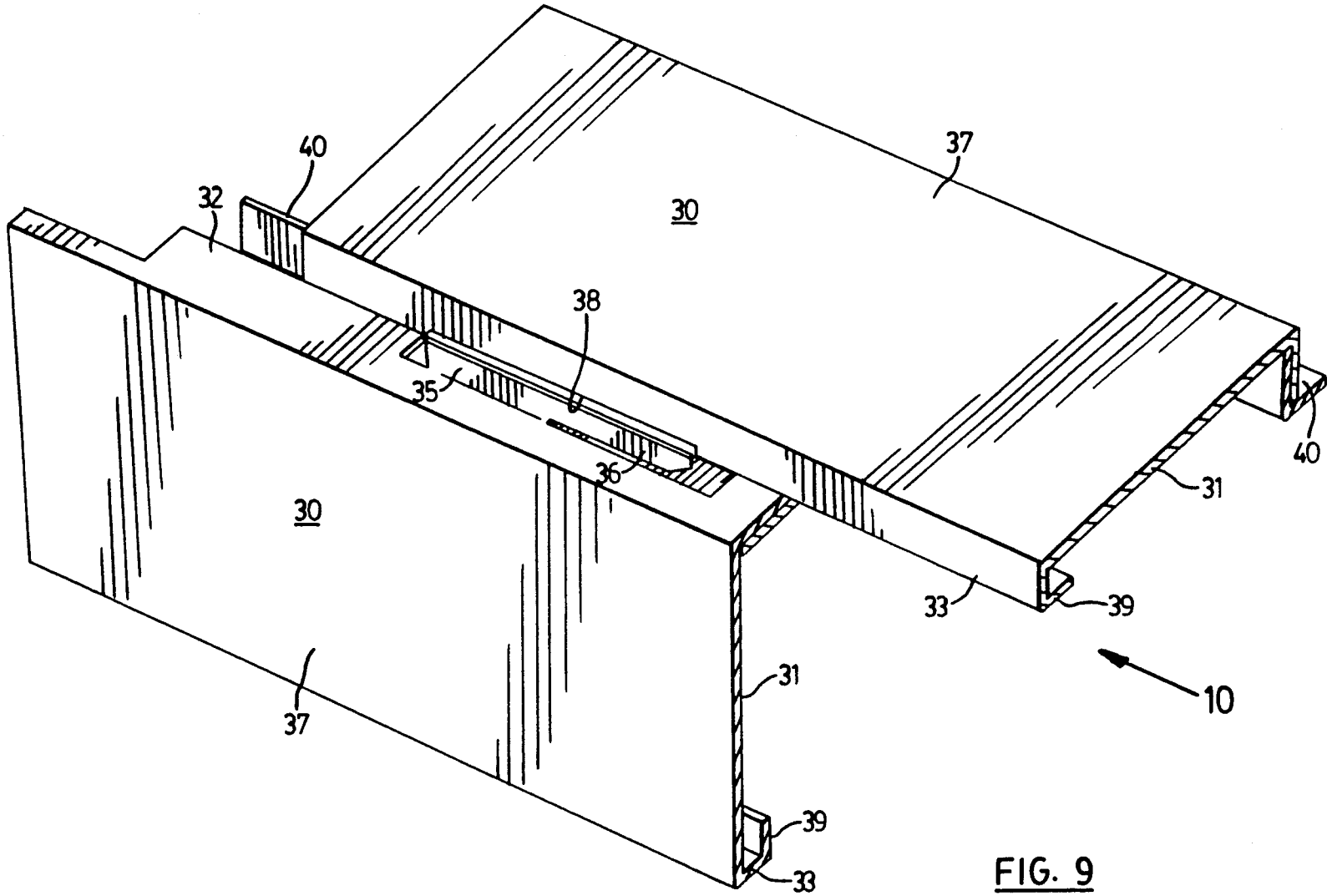
FIG. 9 is a pictorial representation indicating the assembly of the slats of the tambour door of FIGS. 1 through 4.

A latch means 75 of substantially triangular cam configuration is pivoted at one base corner 76 to the rear of the leading edge and a spring 77 provides a biasing means for the other base corner 78 of the latch 75, to bias the latch to a point away from the leading edge (see FIG. 8). A cam surface adjacent the third corner of the triangular latch 75 provides an engaging surface for the bolt 71 of the securing combination lock 70.

Figure 7:
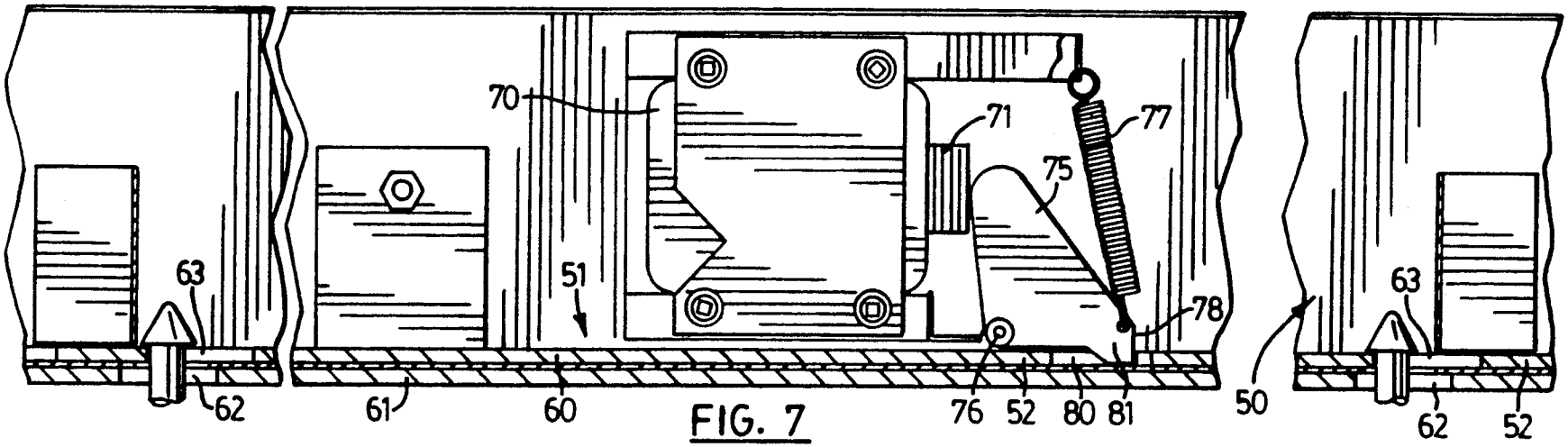
FIG. 7 is a detail of the locking arrangement of the device according to FIG. 4 from the inside outwardly of the cabinet and with the lock in the locked position.

As will be seen in FIGS. 7 and 8 the sliding portion of the bar 60 provides a catch means in the form of a slot 80 which receives and retains the locking tip 81 of the latch 75. To securely lock the door 25, it is moved by its handles 28 until the leading edge 51 contacts the sill 66, the projections 64 being received in the slots 62, 63 in the bar 52. The handle 58 is then operated to slide the bar portion 60 into engagement with the underside of the conical heads 67 and the combination lock 70 is operated to cause its bolt 71 to be extended and rotate the latch 75 about it pivot point 76 and against the bias of its spring 77, so that the engaging tip 81 of the latch engages in the slot 81 in the bar, securing the door 25.

When it is desired to unlock the door, the combination lock 70 is unlocked so that its bolt 71 is withdrawn. The spring 77 then exerts a biasing action to rotate the latch 75 about its pivot point 76 and lift its locking tip 81 clear of the catch 80. The handle 58 can then be moved transversely so as to move the sliding portion 60 of the bar 52 to clear the underside of the conical heads 67 thereby permitting the door 25 to be moved upwardly clear of the projection 64.

Figure 1:
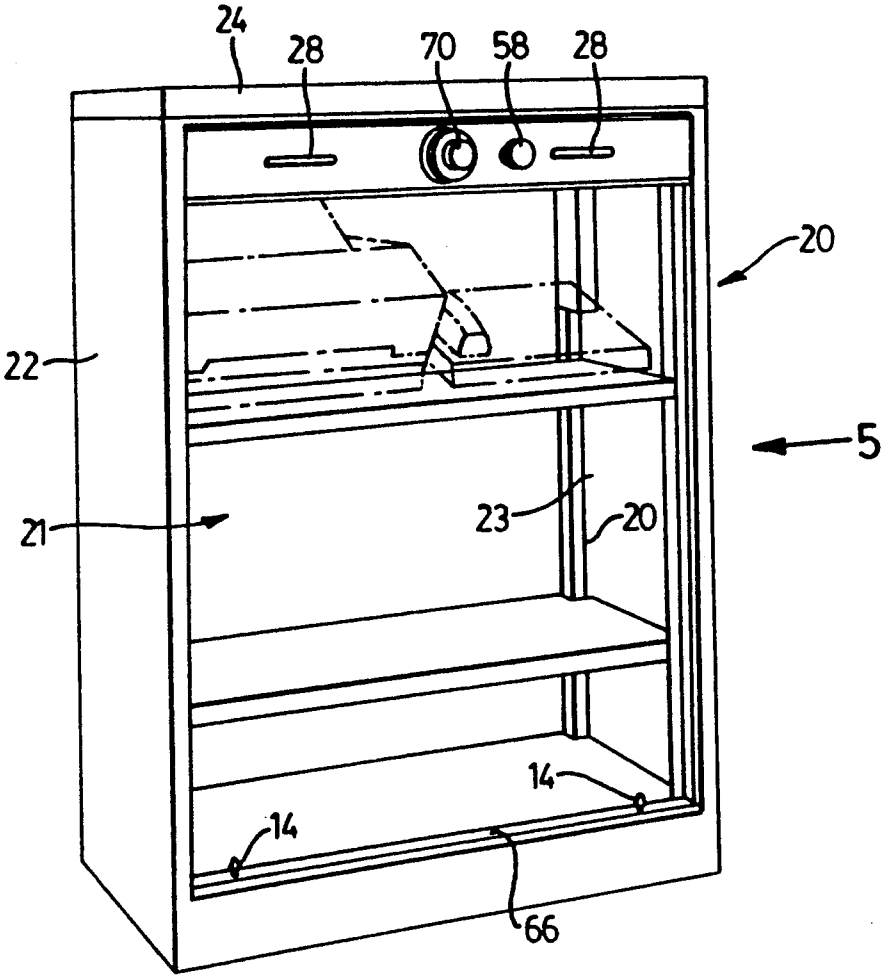
FIG. 1 is a pictorial representation of one form of security cabinet in accordance with the present invention with the door open.

Referring now to FIG. 5 and again to FIG. 1, the left and right side members 22, 23 provide at their rear, vertically extending channel guideways 85. The guideways are inwardly directed and face each other and are formed by inturned backs 86 of each side and welded angle brackets 87. A U-shaped upper structural member 91 is formed integrally with the rear edge of the cabinet roof 24 and extends transversely of the cabinet and inwardly thereof. A lower structural member 94 is formed integrally with the floor 95 and extends transversely of the back of the cabinet, inwardly of the guideways. A back side panel 100 extends vertically within the guideways and terminates at its upper end in an L-section cross member 101 which engages the inside of the inner upstanding web 102 of structural member 91 and is riveted thereto at 104 from the inside of the cabinet. The back side panel 100 also has an inwardly directed bottom edge 108 that engages with the lower structural member 94 and is riveted at 106 to the lower structural member 94 from the underside of the cabinet.

Figure 5:
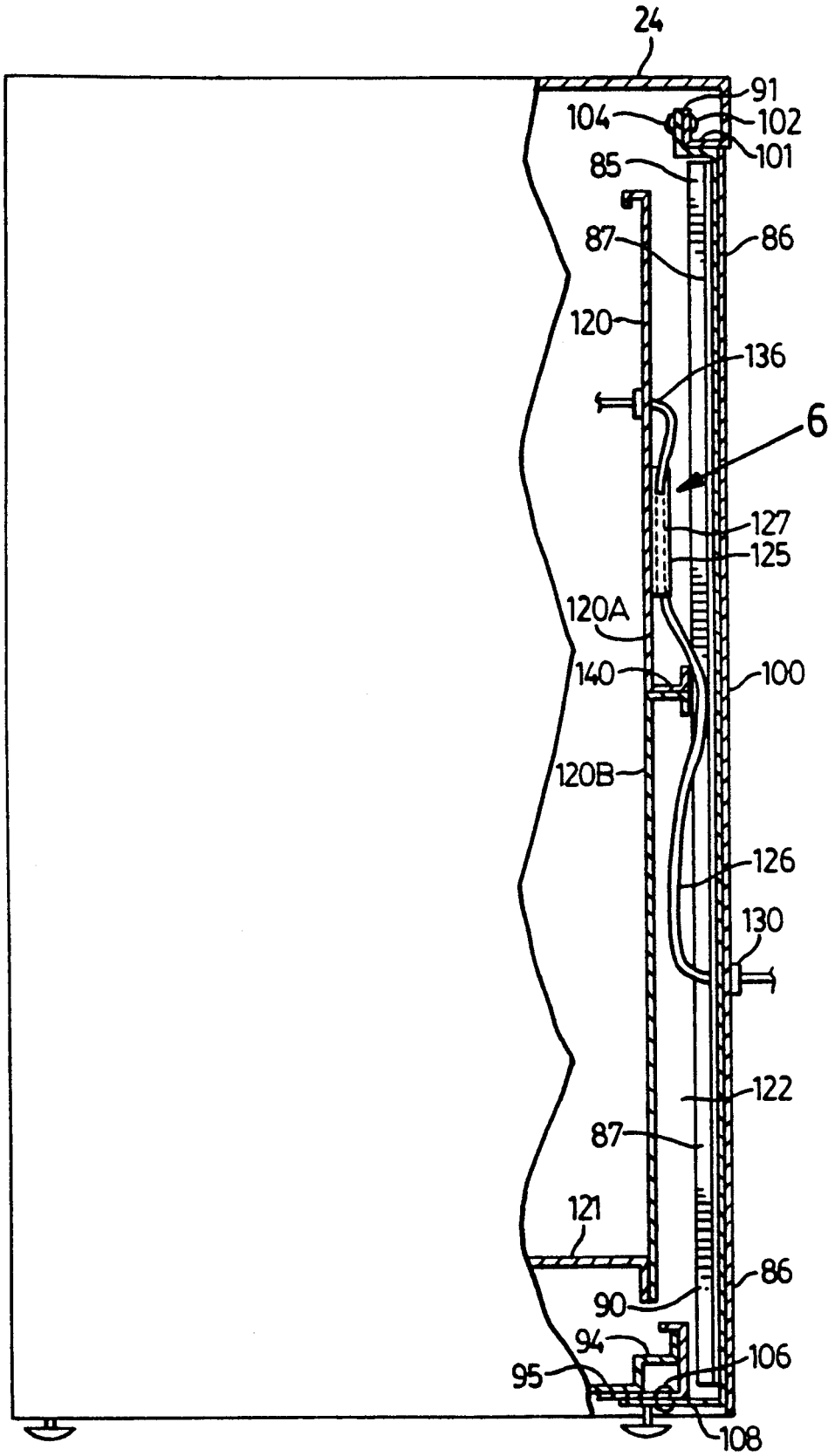
FIG. 5 is a side elevation, partially in section showing the rear of the cabinet.
Figure 6:
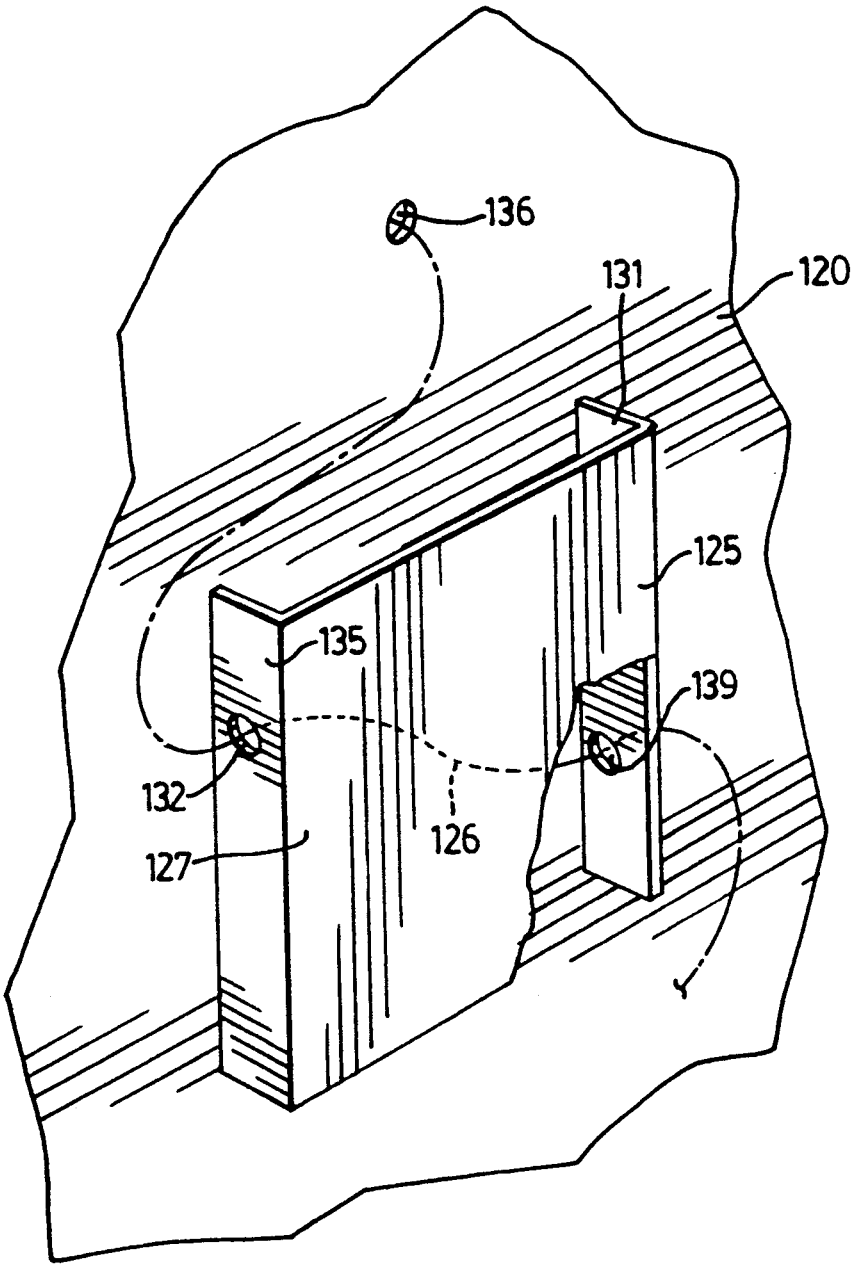
FIG. 6 is a detail of a wiring box indicated by the arrow in FIG. 5.

Turning now to FIG. 6 and again referring to FIG. 5, the panel 100 here forms an outer panel and an inner panel 120 is secured to the inside of the cabinet 121, and is spaced inwardly from the panel 100 so as to form a wiring space 122 between the panels. As best seen in FIG. 6, a U-shaped member 125 is attached, preferably by welding, to the panel 120 and forms therewith an open topped and bottomed box 127. An electrical wiring entrance aperture 130 is provided in the panel 100 which aperture is vertically displaced below the box 127 to receive and pass electrical wiring 126 into the cabinet for whatever purpose, lighting, ventilation, telecommunications, etc. is desired. The box 127 has a wiring inlet aperture 139 on one side 131 of the box and a wiring outlet aperture 132 on the opposite side 135 of the box. The apertures 139 and 132 are vertically displaced one from the other. Finally, a wiring exit aperture 136 is provided in the back of the inner panel 120 and through it passes the wiring cables 126 into the interior of the cabinet. As shown, the inner panel 120 is provided in two sections 120A and 120B connected at the middle by a ledge 140 which further complicates the wiring path.

It will be noted that the wiring passing from outside of the cabinet rear through the aperture 136 to the inside of the cabinet follows an extremely tortuous path, making it virtually impossible for an intruder to insert a fibre optic device into the interior of the cabinet near the electrical connection lanes. It will be understood that if desired the entrance 130 could be higher than the box 127 and the aperture 130 could be higher than the aperture 132 in the box and similarly the aperture 136 could be otherwise staggered.

It will be also noted that the rear panel 100 (see FIG. 5) is connected to the cabinet in such a fashion that the attaching rivets are not exposed to the external surface of the cabinet and consequently can not be or are difficult to be tampered with.

Further, it will be understood that the locking means illustrated in FIGS. 7 and 8 could equally well be attached to the cabinet, say at its lower sill 66 and the projections 64 provided on the leading edge of the tambour door.

It will be clear that in the FIG. 2 configuration the projections 64 will be provided on the edge of the bottom half section 27 when the lock 70 is positioned on the half section 26.

Thus, it will be seen that a secure cabinet is provided which is difficult to infiltrate so that any telecommunications device or documents stored within the cabinet are safe.

What I claim as my invention is:

1. A security cabinet comprising a housing having a front with a door opening, a tambour door mounted on said housing movable between a first position wherein said door opening is uncovered and a second position wherein said door opening is covered, said door comprising a plurality of interlocked slats capable of limited flexure relative to one another, each of said slats having a frontal wall with an outwardly directed front face and an upper side wall and a lower side wall, one of said upper and lower side walls having a hooked tongue means extending therefrom, the other of said upper or lower side walls having a tongue receiving and retaining slot means, and each of said slats having a protection barrier member extending from the same side wall as the hooked tongue means and positioned on said same side wall inwardly from said outwardly directed front face and inwardly from, and behind said hooked tongue means, said protection barrier member of any one slat to inhibit access to a joint formed by the hooked tongue means on said one slat with the receiving and retaining slot means of an adjacent slat when the hooked tongue means of said one slat is received and retained in the receiving and retaining slot means of said adjacent slat.

2. A cabinet as claimed in claim 1 in which said hooked tongue means of each of said slats comprises at least one hooked tongue extending from the same side wall of each of said slats and in which said tongue receiving and retaining slot means of each of said slats comprises at least one matching, receiving and retaining slot in the other slat side wall.

3. A cabinet as claimed in claim 2 in which said at least one hooked tongue is disposed on said upper side wall.

4. A security cabinet comprising a housing having a door opening, a tambour door mounted on said housing movable between a first position wherein said door opening is uncovered and a second position wherein said opening is covered, said door comprising a plurality of interlocked slats capable of limited flexure relative to one another, each of said slats having a frontal wall with an outwardly directed front face and an upper side wall and a lower side wall, one of said upper or lower side walls having a hooked tongue means extending therefrom, the other of said upper or lower side walls having a tongue receiving and retaining slot means, and each of said slats having a protection barrier member extending from the same side wall as the hooked tongue means and positioned on said same side wall inwardly from said outwardly directed front face and inwardly from, and behind said hooked tongue means, said protection barrier member of any one slat to inhibit access to a joint formed by the hooked tongue means of said one slat with the receiving and retaining slot means of an adjacent slat, when the hooked tongue means of said one slat is received and retained in said receiving and retaining slot means of said adjacent slat; a leading edge on said door; locking means adjacent said leading edge to lock with a cooperating locking surface; said locking means comprising a bar means mounted for locking and unlocking movement transversely of said door opening at a rear face of one of said leading edge and said cooperating locking surface and carrying engagement means adapted to releasably engage with at least one locking projection on the other of said leading edge and cooperating locking surface; latch means mounted adjacent said bar means, catch means on said bar means to lockingly receive said latch means, biasing means to bias said latch means in a direction away from said catch means; and securing means operable from outside said cabinet to, on the one hand overcome said biasing means and force said latch means into said catch means to prohibit transverse movement of the bar means and, on the other hand, to release said latch means to permit the biasing means to withdraw said latch means from said catch means.

5. A security cabinet comprising a housing having a door opening: a tambour door mounted on said housing movable between a first position wherein said door opening is uncovered and a second position wherein said opening is covered; said door comprising a plurality of interlocked slats capable of limited flexure relative to one another; a leading edge on said door, a cooperating locking surface; locking means adjacent one of said leading edge and said cooperating locking surface; said locking means comprising a bar means mounted for locking and unlocking movement transversely of said door opening at a rear face of one of said leading edge and said cooperating locking surface and carrying engagement means adapted to releasably engage with at least one locking projection of the other of said leading edge and cooperating locking surface; latch means mounted adjacent said bar means; catch means on said bar means to lockingly receive said latch means; biasing means to bias said latch means in a direction away from said catch means; and securing means operable from outside said cabinet to, on the one hand, overcome said biasing means and force said latch means into said catch means to prohibit transverse movement of the bar means and, on the other hand, to release said latch means to permit the biasing means to withdraw said latch means from said catch means.

6. A security cabinet comprising a housing having a door opening; a tambour door having an outwardly directed front face, and an inwardly directed rear face, said door being mounted on said housing movable between a first position wherein said door opening is uncovered and a second position wherein said opening is covered; said door comprising a plurality of interlocked slats capable of limited flexure relative to one another; a leading edge on said door, locking means adjacent said leading edge to lock said leading edge with a cooperating locking surface, said locking means comprising a bar means mounted at a rear face of said leading edge for locking and unlocking movement transversely of said door opening, engagement means on said bar means adapted to releasably engage with at least one locking projection on said cooperating locking surface; latch means on said rear face of said door adjacent said bar means, catch means on said bar means to lockingly receive said latch means; biasing means to bias said latch means in a direction away from said catch means; and securing means operable from said outwardly directed front face of said door to, on the one hand overcome said biasing means and force said latch means into said catch means to prohibit transverse movement of the bar means, and, on the other hand, to release said latch means to permit the biasing means to withdraw said latch means from said catch means.

7. A cabinet as claimed in claim 5 or claim 6 in which said at least one locking projection is cylindrical in shape, said at least one locking projection terminating in an enlarged conical head, and said engagement means comprises slots in said bar means dimensioned to pass said at least one locking projection, and in the locked position when the bar means is moved transversely of the door opening, to lockingly engage beneath said conical head.

8. A cabinet as claimed in claim 6 in which said latch means is substantially of triangular cam configuration, pivoted at one base corner to the rear face of the said leading edge, spring biased at its other base corner to a point away from said leading edge and providing at a point adjacent its third corner a surface against which a bolt of said securing means may act.

9. A cabinet as claimed in claim 8 in which said securing means is a combination operated lock.

10. A cabinet as claimed in claim 7 in which said cooperating locking surface is a bottom sill of said door opening and in which said at least one locking projection is mounted in, and upstands from, said bottom sill.

11. A security cabinet comprising a housing having a door opening, a tambour door mounted on said housing movable between a first position wherein said door opening is uncovered and a second position wherein said opening is covered; said door comprising a plurality of interlocked slats capable of limited flexure relative to one another, each of said slats having a frontal wall with an outwardly directed front face and an upper side wall and a lower side wall, one of said upper or lower side walls having a hooked tongue means extending therefrom, the other of said upper or lower side walls having a tongue receiving and retaining slot means, and each of said slats having a protection barrier member extending from the same side wall as the hooked tongue means and positioned on said same side wall inwardly from said outwardly directed front face and inwardly from, and behind said hooked tongue means, said protection barrier member of any one slat to inhibit access to a joint formed by the hooked tongue means of said one slat with the receiving and retaining slot means of an adjacent slat, when the hooked tongue means of said one slat is received and retained in said receiving and retaining slot means of said adjacent slat; left and right side members of said housing each having a rear edge, side left and right side members mounting vertically extending channel guideways proximate said rear edges thereof, said guideways being inwardly directed to face each other; a cabinet roof having a substantially U-shaped upper structural member formed integrally with said cabinet roof and extending transversely and inwardly thereof; a lower structural member formed integrally with a floor of the cabinet and extending transversely thereof inwardly of said guideways; a back side panel extending vertically within the guideways and terminating at its upper end in an L-section cross member engaging an inside of an inner upstanding web of said U-shaped upper structural member and riveted thereto from an inside of said cabinet; and an inwardly directed bottom edge on said back side panel engaging said lower structural member and riveted thereto from an underside of said cabinet.

12. A security cabinet comprising a four sided housing including a front side, a door opening in said front side of said housing, a door mounted on said housing movable between a first position wherein said door opening is uncovered and a second position wherein said opening is covered; a left side member and a right side member of said housing, each having a rear edge, said left and right side members mounting vertically extending channel guideways proximate the rear edges thereof, said guideways being inwardly directed to face each other; a cabinet roof having a substantially-shaped upper structural member formed integrally with said cabinet roof and extending transversely and inwardly thereof; a lower structural member formed integrally with a floor of the cabinet and extending transversely thereof inwardly of said guideways; a back side panel extending vertically within the guideways and terminating at its upper end in an L-section cross member engaging an inside of an inner upstanding web of said U-shaped upper structural member and riveted thereto from an inside of said cabinet; and an inwardly directed bottom edge on said back side panel engaging said lower structural member and riveted thereto from an underside of said cabinet.

13. A security cabinet comprising a housing having a door opening, a tambour door mounted on said housing, movable between a first position wherein said door opening is uncovered and a second position wherein said opening is covered; said door comprising a plurality of interlocked slats capable of limited flexure relative to one another, each slat having a frontal wall with an outwardly directed front face and an upper side wall and a lower side wall, one of said upper or lower side walls having a hooked tongue means extending therefrom, the other of said upper or lower side walls having a tongue receiving and retaining slot means, and each slat having a protection barrier member extending from the same side wall as the hooked tongue means and positioned on said same side wall inwardly from said outwardly directed front face and inwardly from and behind said hooked tongue means, said protection barrier member of any one slat to inhibit access to a joint formed by the hooked tongue means of said one slat with one receiving and retaining slot means of an adjacent slat, when the hooked tongue means of said one slat is received and retained in said receiving and retaining slot means of said adjacent slat; a first outer panel having an inwardly directed face, said outer panel forming one side of said cabinet; an inner panel structurally secured to an inside of said cabinet and spaced inwardly from, and parallel to, said outer panel to form a wiring space between the panels, said inner panel having an outwardly directed rear face facing said inwardly directed face of said outer panel; a substantially U-shaped member attached to said outwardly directed rear face of said inner panel and forming therewith an open topped and bottomed box member having a first side and an opposite side; an electrical wiring entrance aperture in said outer panel vertically displaced thereon from said box member; a wiring inlet aperture on the opposite side of the box member and vertically spaced thereon from said inlet aperture; and a wiring exit aperture in said inner panel and vertically displaced thereon from said box member and said entrance aperture, whereby wiring entering said entrance aperture, passing through said box member and through said exit aperture is forced to follow a tortuous path.

14. A security cabinet comprising a rectangular housing having a front, a door opening in said front of said housing, a door mounted on said housing movable between a first position wherein said door opening is uncovered and a second position wherein said opening is covered; a first outer panel having an inwardly directed face, said outer panel forming one side of said cabinet; an inner panel structurally secured to an inside of said cabinet and spaced inwardly from, and parallel to, said outer panel to form a wiring space between the panels, said inner panel having an outwardly directed rear face facing said inwardly directed face of said outer panel; a substantially U-shaped member attached to said outwardly directed rear face of said inner panel and forming therewith an open topped and bottomed box member having a first side and an opposite side; an electrical wiring entrance aperture in said outer panel vertically displaced thereon from said box member; a wiring inlet aperture on the first side of the box member; a wiring outlet aperture on the opposite side of the box member and vertically spaced thereon from said inlet aperture; and a wiring exit aperture in said inner panel vertically displaced thereon from said box member and said entrance aperture, whereby wiring entering said entrance aperture, passing through said box member and through said exit aperture is forced to follow a tortuous path.

15. Apparatus as claimed in claim 14 in which said entrance aperture is beneath said box member and said exit aperture.

16. Apparatus as claimed in claim 15 in which said outlet aperture in said box member is above said inlet aperture.

17. Apparatus as claimed in claim 16 in which said wiring exit aperture is above said box member.

18. A cabinet as claimed in claim 14 in which said inner panel is constructed in two sections jointed at a transversely extending ledge.

* * * * *

UNITED STATES PATENT AND TRADEMARK OFFICE

CERTIFICATE OF CORRECTION

PATENT NO. : 5,295,743

DATED : March 22, 1994

INVENTOR(S) : John L. Moulton, et al

It is certified that error appears in the above-indentified patent and that said Letters Patent is hereby corrected as shown below:

IN THE CLAIMS

Claim 11, column 10, line 68, before "left" cancel "side" and insert --said--.

Claim 12, column 11, line 28, before "-shaped", insert -- U--.

Claim 13, column 12, line 16, before "opposite side", insert --first side of the box member; a wiring outlet aperture on the--.

Signed and Sealed this

Sixteenth Day of May, 1995

*Attest:*

Bruce Lehman

BRUCE LEHMAN

*Attesting Officer*

*Commissioner of Patents and Trademarks*